United States Patent [19]

Sacerdote

[11] Patent Number: 4,570,358

[45] Date of Patent: Feb. 18, 1986

[54] SPORTS RACKET HANDLE DRYING DEVICE

[75] Inventor: Giacomo M. Sacerdote, Cobham, England

[73] Assignee: Ypsilon Limited, London, England

[21] Appl. No.: 544,833

[22] Filed: Oct. 24, 1983

[30] Foreign Application Priority Data

Nov. 15, 1982 [GB] United Kingdom ..... 8232581

[51] Int. Cl.[4] ..... F26B 9/06

[52] U.S. Cl. ..... 34/54; 34/55; 34/107; 34/202; 273/75

[58] Field of Search ..... 34/54, 55, 202, 218, 34/239, 107; 273/73 J, 75

[56] References Cited

U.S. PATENT DOCUMENTS

| | | | |
|---|---|---|---|
| 2,207,331 | 7/1940 | Patterson | 34/54 |
| 2,373,339 | 4/1945 | Roberts | 34/54 |
| 3,797,475 | 3/1974 | Hughes | 34/99 |
| 3,820,251 | 6/1974 | Abernathy | 34/202 |
| 4,082,276 | 4/1978 | Szafianski | 273/75 |
| 4,480,394 | 11/1984 | Salas | 34/202 |

FOREIGN PATENT DOCUMENTS

| | | | |
|---|---|---|---|
| 2357873 | 9/1974 | Fed. Rep. of Germany | 34/202 |
| 229819 | 11/1943 | Switzerland | 34/202 |

*Primary Examiner*—Albert J. Makay
*Assistant Examiner*—David W. Westphal
*Attorney, Agent, or Firm*—Kane, Dalsimer, Kane, Sullivan and Kurucz

[57] ABSTRACT

A sports racket handle drying device comprises an electrically operated fan (5), a tube (3) for receiving the handle of the sports racket and means (6,10,11 and 12) for actuating the fan, in response to the presence of the handle in the tube, to effect flow of air between the tube and the handle.

4 Claims, 2 Drawing Figures

SPORTS RACKET HANDLE DRYING DEVICE

BACKGROUND OF THE INVENTION

The present invention relates to a sports racket handle drying device.

The grip of the handle of a sports racket (for example, a tennis, badminton or squash racket) inevitably becomes wet during play owing to perspiration of the player. Heretofore, players have used a towel to dry the handle grip during intervals in the game. This is not only an inefficient but also a time-consuming operation and leaves less time, especially during tournament play when only short predetermined intervals are allowed, for the player to attend to his personal needs.

SUMMARY OF THE PRESENT INVENTION

The present invention provides a sports racket handle drying device, the device comprising an electrically operated fan, a tube for receiving the handle of the sports racket and means for actuating the fan, in response to the presence of the handle in the tube, to effect flow of air between the tube and the handle.

The device according to the invention allows a player to place the racket handle in the tube whereby the fan is actuated to produce a flow of air between the tube and the handle and thereby to dry the handle.

Although it would be possible for the fan to suck air through the tube it is preferred if the fan is arranged to blow air along the tube.

A particularly simple arrangement is provided if the fan is disposed at one end of the tube and the handle is insertable into the tube through its other end.

Although the fan could be mains-operated it is preferred if it is battery-operated which makes the device safer in use and also more portable.

A heater may be provided so that the fan effects a warm air flow over the handle but it is preferred if the air flow is unheated so that it effects cooling of the handle. In this way the grip is not only dried but also cooled which provides a better feel for the player after the device has been used.

It is of advantage if the actuating means is arranged to be maintained in its actuating condition by the weight of the racket. This leads to a very simple construction.

Various actuating means can be employed but it is of advantage if it is an electric switch. In that case, the switch may comprise a normally open movable contact which is held in its closed position by the weight of the racket when the handle is in the tube.

It is of advantage, to enable the device fully to support the racket and to allow the player to attend to his personal needs, if the device includes a support means by which the tube can be maintained in an upright position when it has received the racket handle.

The support means can take various forms but it is preferred if it comprises a weighted base. In this way the device can be simply mounted on a flat surface or on the floor.

BRIEF SUMMARY OF THE DRAWINGS

A portable sports racket handle drying device, the device being constructed in accordance with the present invention, will now be described by way of example only with reference to the accompanying drawing in which.

DETAILED DESCRIPTION OF THE PREFERRED EMBODIMENT

Figure 1:
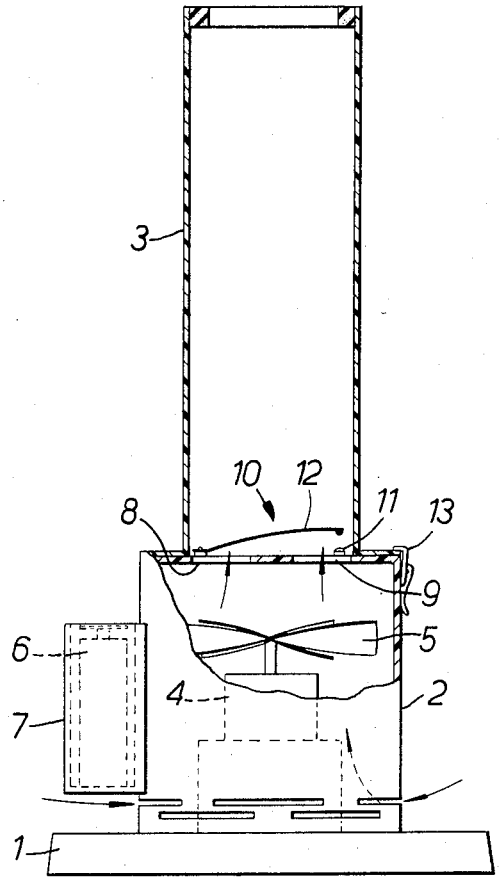
FIG. 1 is a diagrammatic side elevation, partially in section, of the device.

Referring to the accompanying drawings, the device comprises a base 1 a fan unit housing 2 and a tube 3 for receiving the handle of a sports racket.

The base 1 enables the device to be supported on a flat surface and is suitably weighted to ensure that the device is stable in that condition when a racket handle is inserted into the tube 3 and the tube provides the only support for the racket.

The housing 2 accommodates an electric motor 4 for driving a fan 5. Power to the motor is provided by a battery 6 which is mounted in a holder 7 arranged on the outside of the housing 2.

Figure 2:
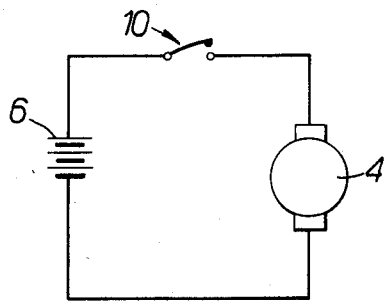
FIG. 2 is a circuit diagram incorporating a motor for the fan of the device.

Arranged on a bracket 8 at an upper opening 9 in the housing is an electric switch 10 which includes a fixed contact 11 and a normally open movable contact 12. The motor 4, the switch 10 and tthe battery 6 are connected in circuit as shown in FIG. 2.

The tube is detachably connected to the housing 2 by releasable clips 13 to facilitate cleaning and/or inspection of the tube or the fan unit. When the tube is in position on the housing 2 the movable contact 12 protrudes slightly into the tube.

When the racket handle is inserted into the tube 3 the weight of the racket presses the movable contact 10 downwards until it engages the fixed contact 9, those contacts being maintained in engagement as long as the racket is left with its handle in the tube 3. Engagement of the two contacts completes the circuit (FIG. 2) and the motor drives the fan to blow air along the tube 3, from bottom to top as shown in FIG. 1, which effects drying of the grip of the handle.

Various modifications can be made to the drying device as described and illustrated above. For example the battery can be arranged within the housing 2. For many purposes, however, it is convenient to have a holder outside the housing as this facilitates insertion and removal of the battery as and when required.

Further, a support means for example a bracket can be provided (attached for example to the housing 2) in order to support the device on a fixed member (not shown)—for example, part of an umpire's chair—and that support means may be used instead of, or in addition to the weighted base 1.

The tube 3 may be attached to the fan unit housing 2 in other ways—for example by screw-theaded engagement.

Clearly the diameter of the tube 3 should be large enough to accommodate standard ranges of racket handle diameters and it will be appreciated that the diameter of the tube should not be too large (that is to say the gap between the racket handle and the tube should not be too great) as this would reduce the drying efficiency of the device.

It will be evident that the device described and illustrated above allows the player to insert the racket handle in the device and leave it there whilst he attends to his personal needs during intervals in the game.

I claim:

1. A sports racket handle drying device, the device comprising:

upwardly extending tube means for receiving and holding a downwardly inserted sports racket handle to be dried, said tube means comprising a single tube having a first upper end and a second lower end, said first and second ends being open to permit passage of air axially along the length of the tube and the opening at said first end being sized to permit entry of said handle into the tube and passage of air in a peripheral space between said handle and said tube, said tube being imperforate so as to permit air flow from one end to the other of the tube only;

an electrically operated fan mounted adjacent the second end of the tube and lying in an air flow path passing axially through said tube between said first and second ends; and actuating means adapted to actuate said electrically operated fan in response to insertion of the handle in the tube to effect an axial flow of air in said peripheral space.

2. The sports racket handle drying device as set forth in claim 1, wherein said second end of the tube has an opening of greater diameter than the opening of said first end.

3. The sports racket handle drying device as set forth in claim 2, wherein said fan is arranged to blow air along the tube and the air flow is unheated.

4. A tennis racket handle drying device, said device comprising:

base means adapted to be supported on a flat surface;

a housing mounted to said base;

air flow entry means for said housing located adjacent said base means;

air flow exit means located at the end of said housing remote from said base means;

a rotary fan located within said housing in an air flow path between said air flow entry means and said air flow exit means;

an electric motor mounted in said housing and adapted to rotate said fan;

a single-walled imperforate tube mounted in a vertical orientation on said housing with one end of said tube enclosing said air flow exit means, said tube being adapted to permit downward entry of a sports racket handle to be dried, to hold said handle and to permit passage of air in a peripheral space between said handle and the said tube;

electrical switch means mounted in the base of said tube and adapted for actuation by weight of the racket acting on the electric swich means;

battery connection means; and an electric circuit interconnecting said battery connection means, said electric contact means and said electric motor.

* * * * *